United States Patent [19]

Dean

[11] Patent Number: 4,610,049

[45] Date of Patent: Sep. 9, 1986

[54] AIRCRAFT BELT LOADER HINGE ASSEMBLY HAVING A SPRING LOADED SHOCK ABSORBING HINGE SUPPORT

[75] Inventor: William C. Dean, Orange City, Fla.

[73] Assignee: FMC Corporation, Chicago, Ill.

[21] Appl. No.: 778,778

[22] Filed: Sep. 24, 1985

Related U.S. Application Data

[63] Continuation of Ser. No. 586,522, Mar. 5, 1984, abandoned.

[51] Int. Cl.[4] ..... E05F 1/12

[52] U.S. Cl. ..... 16/286

[58] Field of Search ..... 16/287, 286, 44; 198/318

[56] References Cited

U.S. PATENT DOCUMENTS 1,340,866 5/1920 Witter ..... 16/287

1,467,124 9/1923 Sunde et al. ..... 16/286

2,420,411 5/1947 Blount, Sr. ..... 16/287 X

FOREIGN PATENT DOCUMENTS 804584 11/1958 United Kingdom ..... 16/286

*Primary Examiner*—Fred Silverberg

*Attorney, Agent, or Firm*—Ronald C. Kamp; Richard B. Megley

[57] ABSTRACT

A hinge assembly having a polytetrafluorine block affixed to a support member with a guide rod having an enlarged head extending through a guide bore. A compression spring is trapped on the guide rod between the guide block and a nut affixed to the free end thereof. A tube is affixed to the head of a pin extending through the tube and aligned holes and a pair of ears positioned on each side of the tube and attached to the hinged member.

7 Claims, 3 Drawing Figures

AIRCRAFT BELT LOADER HINGE ASSEMBLY HAVING A SPRING LOADED SHOCK ABSORBING HINGE SUPPORT

This is a continuation of application Ser. No. 586,522, filed Mar. 5, 1984, now abandoned.

This invention relates generally to hinge assemblies and, more particularly, to hinge assemblies which permit a hinge member to pivot through 180 degrees from a position in which the hinged member and an adjacent member have surfaces in the same plane to a position in which those surfaces are in engagement.

The covers on the various compartments of an aircraft belt loader are often utilized as walkways or platforms by personnel. When in their operative position the covers should present a level and unobstructed surface. Hinge assemblies which project above this surface present an obstacle to the use of these covers in this manner. Due to the size and weight of the covers, the hinge assemblies should also permit the associated cover to fold over completely to avoid the need of a retaining device to hold them in an open position. Because the personnel servicing the loader may drop the covers, the hinge assemblies should be capable of withstanding the resulting shock loads and the vibrations induced in the large area panels of the covers. The present invention provides a hinge assembly with the above mentioned attributes and which is also relatively maintenance free.

Figure 1:
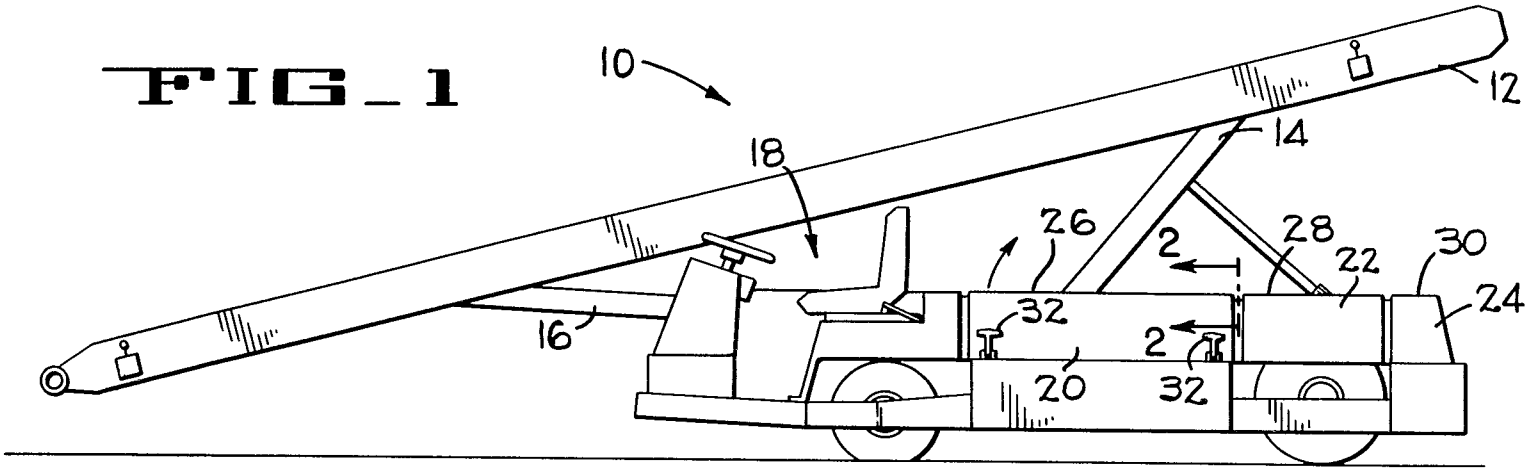
FIG. 1 is a side elevational view of an aircraft belt loader incorporating hinge assemblies according to the present invention.

Referring to FIG. 1, there is shown an aircraft belt loader, indicating generally at 10, having a belt conveyor 12 mounted to one side thereof by a pair of links 14 and 16. An operator station 18 is provided on the left front portion of the loader and is positioned beside the belt conveyor 12. Behind the station 18 and extending alongside the conveyor 12 are a battery compartment with a cover 20, a motor cover 22 and an electrical compartment with a cover 24. The upper surfaces 26, 28 and 30 of the covers 20, 22 and 24 form a level and unobstructed work platform on which personnel can stand to reach luggage or packages on the conveyor, or permits personnel entry to or exit from an adjacent aircraft via the conveyor when the belt is not operating. Any one or more of these covers 20, 22 and 24 may be hinged to the frame of the loader 10, but for brevity, only the hinged connection of the battery cover 20 will be fully described herein.

Figure 2:
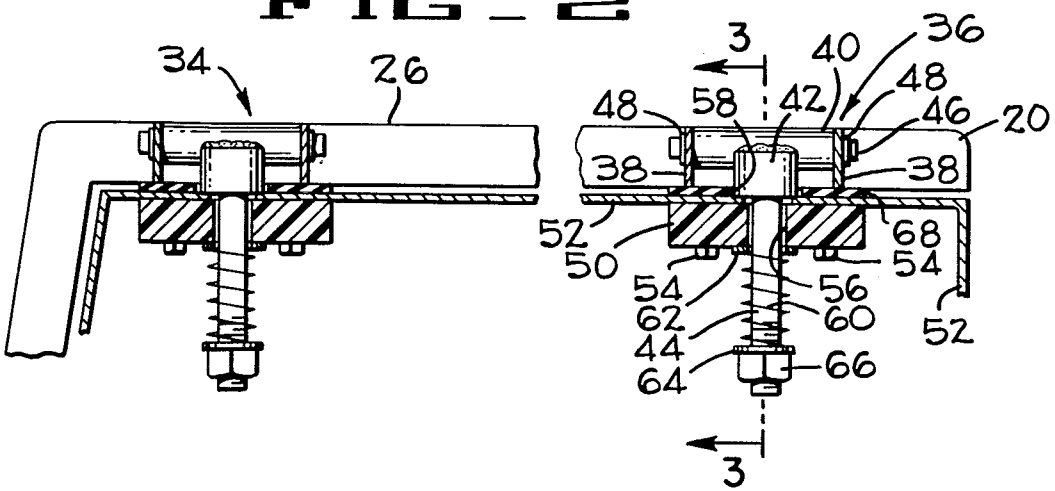
FIG. 2 is a cross sectional view taken on line 2—2 of FIG. 1 with portions broken away and eliminated.
Figure 3:
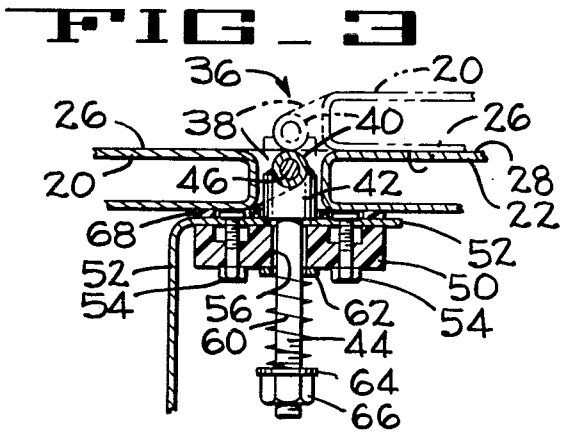
FIG. 3 is a cross sectional view taken on line 3—3 of FIG. 2.

Cover 20 is held in its closed position, as shown in FIG. 1 by releasable latches 32 and is pivoted as indicated by the arrow to an open position, in which the battery is fully exposed for inspection and routine service, essentially about an axis transverse to the conveyor 12. In its open position, surface 26 of cover 20 engages the surface 28 of the motor cover 22, as shown in FIG. 3. The hinge assemblies 34 and 36, as best seen in FIG. 2, do not project above the surface 26 and therefore do not obstruct the aforementioned work surface. Since the hinge assemblies 34 and 36 are identical, only hinge assembly 36 will be fully described herein.

Referring now to the hinge assembly 36 shown on the right of FIG. 2 and in FIG. 3, a pair of ears 38 are secured to the rear vertical edge of cover 20. A tube 40 is affixed to the enlarged head 42 of guide rod 44. A pivot pin 46 extends through the tube 40 and through aligned holes in the ears 38. Snap rings 48 retain the pin 46 in place. A guide block 50, affixed to a support member 52 by fasteners 54, has a central guide bore 56 aligned with a hole 58 in the support member 52. Guide rod 44 extends through the hole 58 and the bore 56 with the head 42 engaging the support member 52 since the hole 58 is larger than the guide rod but smaller than the head. A compression spring 60 is trapped on the rod 44 between a pair of washers 62 and 64; the upper washer 62 bearing on the block 50 and the lower washer on a nut 66 engaging the threaded free end of rod 44. The compression spring 60 normally maintains the head 42 in engagement with the upper surface of the support member 52, but when the surface 26 engages the surface 28 the cover 20 is vertically displaced to the dotted line position shown in FIG. 3; the rod 44 moving upward and compressing spring 60. To facilitate such movement without binding and the need to periodically lubricate, the block 50 is preferably made from polytetrafluorine or such other material having low co-efficients of static and sliding friction. The use of polytetrafluorine material is also advantageous in that the co-efficient of sliding and static friction is substantially equal so that the movement of the rod as it reciprocates within the block is smooth and uniform. The travel or movement capability of the rod 44 is not fully utilized on this normal movement of cover 20 to its fully open position. The additional travel provided before the compression spring becomes "solid" is provided to accommodate movement of the hinge as a result of tools or other objects that have been left on the surface 28. A non metalic gasket 68 is positioned on top of the support member 53 and, by providing contact with the covers 20 and 22, dampens noise producing vibrations should the cover 20 be dropped into either of its positions.

While the preferred embodiment of the present invention has been shown and described herein, it is to be understood that various changes and modifications may be made therein without departing from the spirit of the invention as defined by the scope of the appended claims.

What is claimed is:

1. In operating equipment having a support means, a removable cover, and an adjacent plate, said cover and plate having upper surfaces together defining a substantially coplanar work surface on said equipment;

the improvement therein to enhance utilization of said work surface as well as ready access to portions of said operating equipment beneath said removable cover, comprising:

a pivoting hinge assembly disposed between said removable cover and said plate to permit hinging movement of said cover toward said plate, said hinge assembly including a pair of hinge ears rigidly affixed to said cover between said cover and said plate and below the level of said work surface, and, pivot pin means cooperatively associated with said ears to permit relative pivotal motion therebetween through an arc of substantially 180°;

an elongated guide rod connected to said pivot pin means;

said support means including a separate apertured block secured to the bottom of a support member receiving said guide rod for reciprocable movement substantially perpendicular to said work surface and extending away therefrom on the opposite side thereof through said block thereby to provide no obstruction to said work surface;

spring means interposed between said rod and said block and engaging said rod and said block for retaining said rod connected to said block and normally urging said rod in a direction away from said work surface, said guide rod having a length sufficient to permit said pivot pin means to extend and project from its initial position completely below the work surface to another position entirely above said work surface upon axial movement of said guide rod toward said work surface on compression of said spring means, a gasket being provided between the top of the support member and the bottom of the removable cover and the plate to dampen vibrations, whereby upon pivotal hinging movement of said cover toward said plate, said cover swings freely about said hinge assembly until contact of said cover with said plate above the level of the hinge assembly to form a fulcrum thereat whereupon said guide rod is drawn upwardly against the force of said spring means to elevate the hinge assembly above said work surface as said hinged cover moves through substantially 180° into overlying relationship on said plate, thereby fully supporting said cover on said plate while providing open access to the operating equipment area normally beneath said cover.

2. The improved operating equipment of claim 1 wherein said said block is formed from a material having a low coefficient of friction.

3. The improved operating equipment of claim 1 wherein said operating equipment has a plurality of said hinged covers and said hinge assemblies thereon, thereby to provide additional work surfaces and areas of access to the operating equipment thereunder.

4. The improved operating equipment of claim 1 wherein said operating equipment is an aircraft belt loader having a powered conveyor, and said work surfaces are disposed adjacent said conveyor for use as personnel walkways.

5. The improved operating equipment of claim 1 wherein said hinged cover includes a substantially planar undersurface beneath said upper surface thereof, whereby said undersurface is exposed and may be used for a further work surface when said cover is hinged to fully open position.

6. The improved operating equipment of claim 1 wherein said guide rod has an enlarged head thereon, and said spring means is a compression spring surrounding said guide rod and bearing against said enlarged head and said support member respectively.

7. The improved operating equipment of claim 1 wherein said spring means has a value sufficient to compensate for a substantial portion of the weight of the cover as the cover passes the vertical in swinging downward into overlying contact with said plate, thereby to minimize any hazard of dropping the cover under the sole force of gravity.

* * * * *